US006237492B1

(12) United States Patent
König et al.

(10) Patent No.: US 6,237,492 B1
(45) Date of Patent: May 29, 2001

(54) CLEANING DEVICE FOR A PRINTING PRESS

(75) Inventors: Werner König, Mannheim; Bernd Sitzmann, Heidelberg, both of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/268,265

(22) Filed: Mar. 15, 1999

(30) Foreign Application Priority Data

Mar. 14, 1998 (DE) ..... 198 11 158

(51) Int. Cl.[7] ..... B41F 35/00
(52) U.S. Cl. ..... 101/425; 101/423
(58) Field of Search ..... 101/425, 424, 101/423, 483, 415.1, 416.1, 417, 418; 15/256.52, 256.51, 256.5; 242/579, 132, 586, 586.4, 587.2

(56) References Cited

U.S. PATENT DOCUMENTS

| | | | | |
|---|---|---|---|---|
| 673,091 | * | 4/1901 | Shepard | 242/586.4 |
| 2,652,918 | * | 9/1953 | Lippert | 242/586.4 |
| 3,195,828 | * | 7/1965 | Kuckhoff et al. | 242/586.4 |
| 3,578,258 | * | 5/1971 | Heine | 242/587.2 |
| 3,802,638 | * | 4/1974 | Dragan | 242/587.2 |
| 3,987,835 | * | 10/1976 | Bloomfield | 101/415.1 |
| 4,525,909 | * | 7/1985 | Newman | 101/127.1 |
| 5,944,085 | * | 8/1999 | Malott | 160/67 |

FOREIGN PATENT DOCUMENTS

| | | | | |
|---|---|---|---|---|
| 0174568 | * | 3/1986 | (EP) | 101/415.1 |
| 0 795 402 A1 | | 9/1997 | (EP) . | |

OTHER PUBLICATIONS

German Utility Model DE 297 06 836 U1, dated Jul. 17, 1997, cleaning device in a printing press.

* cited by examiner

*Primary Examiner*—John S. Hilten
*Assistant Examiner*—Anthony H. Nguyen
(74) *Attorney, Agent, or Firm*—Herbert L. Lerner; Laurence A. Greenberg; Werner H. Stemer

(57) ABSTRACT

A cleaning device for a printing press, having a cloth spindle formed with a longitudinal groove, and a cleaning cloth clampable in the longitudinal groove, comprising a clamping body rotatable inside the longitudinal groove out of a first position, wherein clamping of the cleaning cloth is undone, and into a second position, wherein the cleaning cloth is clamped between the clamping body and an inner face defining the longitudinal groove; and a printing press and, more particularly, a rotary printing press, in combination with the cleaning device.

15 Claims, 4 Drawing Sheets

CLEANING DEVICE FOR A PRINTING PRESS

BACKGROUND OF THE INVENTION

FIELD OF THE INVENTION

The invention relates to a cleaning device for a printing press, having a cloth spindle formed with a slot or a longitudinal groove, a cleaning cloth clampable in the slot, and a clamping body rotatable inside the slot.

Cleaning devices of the foregoing general type are used for cleaning printing ink and other contaminants from rollers, cylinders and drums.

In the published European Patent Document EP 07 95 402 A1, a cylinder cleaning device of this type is described having a cloth spindle formed with a variable circumference. In accordance with one embodiment thereof, a bar that firmly clamps the cleaning cloth to the bottom of a trench formed in the cloth spindle can have an oval cross section and can be embodied so as to be rotatable from a clamping position into a released position in order to undo the clamping. Rotating the bar out of the released position and into the clamping position for the purpose of firmly clamping the cleaning cloth is neither contemplated nor, for structural reasons, possible in this arrangement. On the contrary, this heretofore known arrangement requires that the cleaning cloth be wound in multiple layers around the bar, that is located partly in the trench and partly protruding therefrom, in order to achieve firm clamping. The cloth spindle is unsuited for use as a clean cloth spindle because, when the end of the cloth is reached, the required cloth tension is lost, and the bar falls out of the trench. If the cloth spindle is used as a dirty cloth spindle, all of the cleaning cloth cannot be optimally used, because a relatively long section thereof always remains unused for producing the clamping needed for cleaning purposes. Furthermore, it is not possible to wind the cloth uniformly onto the bar, because the bar protruding from the trench very severely deforms the winding layers at some locations thereof.

A washing device is also described in German Utility Model DE 297 06 836 U1, but it does not match the general type of washing or cleaning device described at the introduction hereto, and the spindle of this prior art device has a slot or longitudinal groove wherein an end of a washcloth is clamped in place by a clamping or lug strip. The clamping strip is not constructed so as to be rotatable inside the longitudinal groove. Although this heretofore known washing device does permit a more exact fastening of the washcloth to the spindle than if adhesive tapes are used, nevertheless the clamping is insecure. Depending upon the nature of the washcloth that is clamped in place, either the washcloth can slip out of the clamped condition, or the resilient clamping strip can snap or spring out of the clamping position. This risk is especially great when a relatively major tensile force is applied to the washcloth. Such a tensile force acts upon the washcloth after the end of the winding is reached when the cloth has been unwound. The washcloth torn out of the clamped condition thereof can be pulled into the printing press and cause severe damage.

SUMMARY OF THE INVENTION

It is accordingly an object of the invention to provide a cleaning device in a printing press wherein the cleaning cloth can be used up quite well, is quickly clampable and reliably clamped.

With the foregoing and other objects in view, there is provided, in accordance with the invention, a cleaning device in a printing press, having a cloth spindle formed with a longitudinal groove, and a cleaning cloth clampable in the longitudinal groove, comprising a clamping body rotatable inside the longitudinal groove out of a first position, wherein clamping of the cleaning cloth is undone, and into a second position, wherein the cleaning cloth is clamped between the clamping body and an inner face defining the longitudinal groove.

In accordance with another feature of the invention, the clamping body, due to the rotation thereof out of the first position and into the second position, is wedgable in the longitudinal groove so as to clamp the cleaning cloth therein.

In accordance with a further feature of the invention, the first position of the clamping body is substantially perpendicular to the second position thereof.

In accordance with an added feature of the invention, the longitudinal groove has a cross section narrowing towards the outside relative to the cloth spindle.

In accordance with an additional feature of the invention, the cross section of the longitudinal groove is narrowed in an infinitely graduated manner towards the outside.

In accordance with yet another feature of the invention, the clamping body is formed with two mutually opposite convex clamping faces.

In accordance with yet a further feature of the invention, the clamping body has a first dimension measurement and a second dimension measurement extending perpendicularly to a pivot axis of the clamping body and in different directions relative to one another, the first dimension measurement being greater than the second dimension measurement.

In accordance with yet an added feature of the invention, the clamping body has a circular cross section with two flat faces disposed opposite one another, the first dimension measurement being the diameter of the circular cross section, and the second dimension measurement being a maximum spacing of the flat faces from one another.

In accordance with yet an additional feature of the invention, the cleaning device includes at least one restraint device for preventing unintended undoing of the clamping of the cleaning cloth and for securing the clamping body against displacement.

In accordance with still another feature of the invention, the clamping body has a rigid structure.

In accordance with still a further feature of the invention, the longitudinal groove and the clamping body are profiled so that the cleaning cloth wrapped around the clamping body is firmly clamped along two clamping lines extending parallel to one another, between the clamping body in the clamping position, and the longitudinal groove.

In accordance with still an added feature of the invention, the clamping body in the clamping position is located entirely inside the longitudinal groove.

In accordance with still an additional feature of the invention, there is provided a printing press, comprising in combination therewith at least one cleaning device having at least some of the foregoing features.

In accordance with a concomitant feature of the invention, there is provided a rotary printing press, comprising in combination therewith at least one cleaning device having at least some of the foregoing features.

Thus, there is provided a cleaning device for a printing press, having a cloth spindle formed with a longitudinal groove or slot, having a cleaning cloth that can be clamped in the longitudinal groove, and having a clamping body that is rotatable inside the longitudinal groove, wherein the clamping body is rotatable inside the longitudinal groove out of a first position and into a second position, the clamping of the cleaning cloth being undone in the first position, and the second position being the clamping position, wherein the cleaning cloth is clamped between the clamping body and the longitudinal groove.

In contrast with the resiliently embodied clamping strip in the washing device of the prior art described hereinabove, the cleaning cloth can be securely clamped in place by the adjustably embodied clamping bodies according to the invention. By an adjusting device disposed perpendicularly to the axial direction of the cloth spindle, both fast release of clamping and fast clamping of the cleaning cloth can be achieved. By constructing the clamping body so that it is rotatable about the pivot axis thereof for adjustment into the clamping position within the longitudinal groove, simple adjustment kinematics and a structurally uncomplicated embodiment of the device are possible.

In an embodiment that advantageously refines the device according to the invention, the clamping body, by the rotation thereof out of the first position and into the second position, can be wedged in the longitudinal groove, and the cleaning cloth can thereby be clamped.

In a further embodiment, the first position is approximately perpendicular to the second position. Rotating the clamping body approximately or precisely 90° makes the device simpler to operate. This virtually precludes insufficient clamping of the cleaning cloth due to faulty operation.

In a further embodiment, the longitudinal groove has a cross section that is narrowed or tapered in an infinitely graduated manner outwardly relative to the cloth spindle, and the clamping body has two convex clamping faces formed mutually opposite one another, on the clamping body. Because of this construction, it is possible to clamp the cleaning cloth without the risk of it being torn or the like.

In a further embodiment, a first dimension measurement and a second dimension measurement of the clamping body extend perpendicularly to a pivot axis of the clamping body and in different directions relative to one another, in particular precisely or approximately perpendicularly to one another, and the first measurement is greater than the second measurement. A clamping body constructed in this manner is not complicated for manufacture. The first and second dimension measurement of the clamping body can extend within a single cross-sectional plane of the clamping body.

An embodiment of the clamping body wherein the two measurements extend within different cross-sectional planes that are offset in the direction of the pivot axis of the clamping body is also possible. For example, this would be the case for a clamping body made of a round material with multiple double bends or cranks as for a crankshaft.

In a further embodiment, the maximum spacing between the curved clamping faces is determined by the larger of the two measurements, and the smaller of the two measurements is smaller than a constriction in the cross section of the longitudinal groove. In this embodiment, the clamping body can be placed radially through the constriction into the longitudinal groove. In addition to this preferred embodiment, provision may also be made for the clamping body to be introduced into the longitudinal groove solely from the end face and pushed into the longitudinal groove in the axial direction.

In a further embodiment, the clamping body has a circular cross section, with two flat faces disposed opposite one another, and the diameter of the circular cross section is the first measurement, and the maximum spacing of the flat faces from one another is the second measurement. This embodiment enables especially economical production of the clamping body from a round profile, which may be chamfered on both sides. The two flat faces preferably extend parallel to one another, and the spacing of the flat faces remains constant. However, an embodiment wherein the flat faces are inclined relative to one another can also be provided.

In a further embodiment, the cleaning device has at least one restraint device, that prevents unintended undoing of the clamping of the cleaning cloth and secures the clamping body against displacement. This additional securing absolutely assures clamping of the cleaning cloth under all circumstances. The restraint device may be form-locking or friction-locking and may, for example, be embodied as a locking member or a clamping screw. It is noted in this regard that a form-locking connection is one which connects two elements together due to the shape of the elements themselves, as opposed to a force-locking connection, which locks the elements together by force external to the elements.

In a further embodiment, the clamping body is of rigid construction. Such a clamping body can be made from a metal, such as steel or aluminum. Because of the rigid, flexurally strong embodiment of the clamping body, the device is very sturdy. This is especially advantageous in the event of improper operation. However, the clamping body can also have a resilient construction. For example, the clamping body may be made from a comparatively elastic profile of plastic material. However, in contrast with the device defining the prior art (the German Utility Model DE 297 06 836 U1), a resilient embodiment of the clamping body in the device of the invention is not absolutely necessary from a functional standpoint.

In a further embodiment, the longitudinal groove and the clamping body are profiled in such a manner that the cleaning cloth, that wraps around the clamping body, is firmly clamped along two clamping lines, extending parallel to one another, between the clamping body adjusted into the clamping position and the longitudinal groove. By the preferred clamping of the cleaning cloth at two points, the cleaning cloth is fastened especially securely to the cloth spindle. However, provision may also be made for the cleaning cloth to be firmly clamped in the longitudinal groove only along a single clamping line. In that case, one of two clamping faces of the clamping body can form the clamping line, while the clamping body is braced with the other clamping face against an inside face of the longitudinal groove, or only a single clamping face may be provided.

In a further embodiment, the clamping body, adjusted into the clamping position, is located entirely inside the longitudinal groove. Because the clamping body does not protrude from the longitudinal groove and past the jacket line, such as the circumferential surface of a cloth spindle of circular cross section, very uniform winding and unwinding are possible.

The cleaning device according to the invention and all the embodiments described hereinabove offer the advantage that a tensile force applied to the cleaning cloth produces self-reinforcement of the clamping. The greater the tension on the cleaning cloth, the more markedly the clamping body becomes wedged inside the longitudinal groove. The cleaning cloth can be clamped in place so firmly that the clamping forces are greater than the tear strength of the cloth material.

The advantages of the cleaning devices of the invention are obtained both in a cleaning device having only one cloth spindle and in cleaning devices having two cloth spindles. Preferably, in a cleaning device that includes both a clean cloth spindle and a dirty cloth spindle, both cloth spindles are constructed in accordance with the invention.

The cleaning device according to the invention can be used in printing presses. Preferably, the cleaning device is used to clean an impression cylinder and/or a rubber blanket cylinder.

Other features which are considered as characteristic for the invention are set forth in the appended claims.

Although the invention is illustrated and described herein as embodied in a cleaning device for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
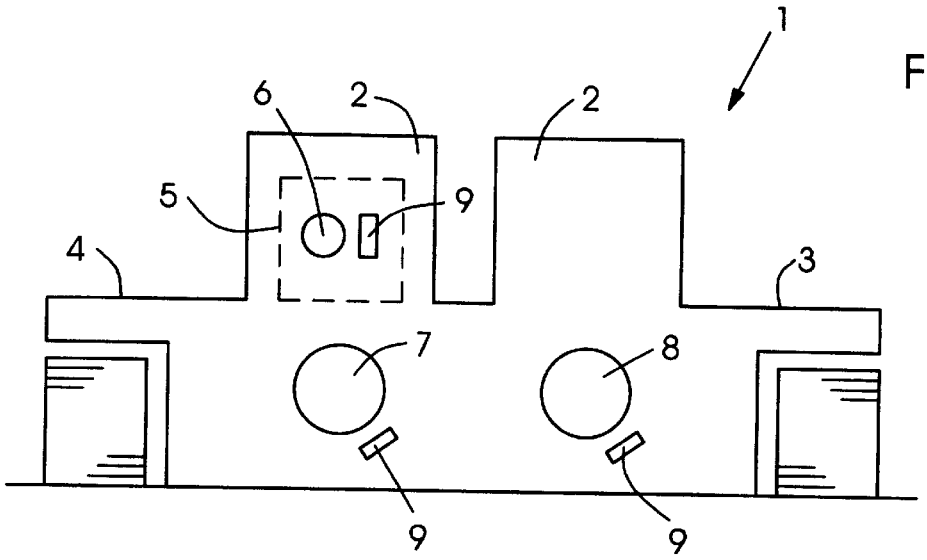
FIG. 1 is a diagrammatic side elevational view of a rotary printing press incorporating therein a plurality of cleaning devices according to the invention.

Referring now to the drawings and, first, particularly to FIG. 1 thereof, there is shown therein a printing press 1 with a plurality of printing units 2, namely two printing units 2 in this embodiment, although the invention is not restricted to that number. Each printing unit 2 includes an inking unit 5 with a roller 6 in a printing press 1 embodied as an offset printing press; a non-illustrated dampening unit may be associated with the inking unit 5 in the printing press 1. Each of the printing units 2 includes a cylinder 7 which, in a printing press 1 embodied as a rotary printing press, can be an impression cylinder and, in a printing press 1 operating by an indirect printing process, can be a rubber blanket cylinder. The printing press 1 can be embodied as a sheet-fed printing press that includes a sheet feeder 3 and a sheet delivery 4, with the printing press 1 having a drum 8 for transporting the sheets of printing material or stock from one printing unit 2 to another. Hereinafter, the roller 6, the cylinder 7 and the drum 8 will all be referred to as the cylinder 6, 7, 8 to which the cleaning device 9 of the invention is assigned. The printing press 1 includes at least one cleaning device 9. It may be employed to clean printing ink and paper particles from the roller 6, cylinder 7 and drum 8.

Figure 2:
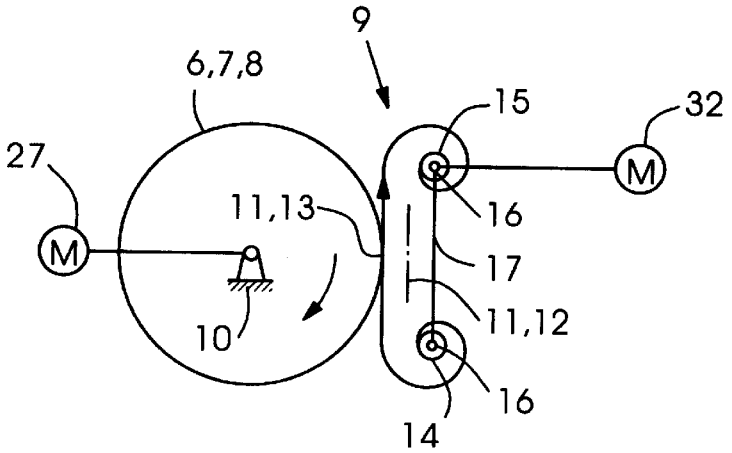
FIG. 2 is an enlarged fragmentary view of FIG. 1, showing diagrammatically and schematically a cleaning device according to the invention.

The cleaning device 9 is shown in greater detail in FIG. 2. The cylinder 6, 7, 8 is rotatably supported in a frame 10, for example, between side walls of the printing press 1. The cylinder 6, 7, 8 is driven to rotate by a drive mechanism 27, and the cleaning cloth 11 is embodied so that it can be pressed against the circumferential surface of the rotating cylinder 6, 7, 8. The cleaning cloth 11 can be positioned out of a spaced-apart position 12 and into a contact position 13 that is required for cleaning the cylinder 6, 7, 8. From a rear side of the cleaning cloth 11, a pressure part can press the front side of the cleaning cloth 11 against the cylinder 6, 7, 8. The cleaning cloth 11 may also be held in contact with the cylinder 6, 7, 8 by the intrinsic tension of the cleaning cloth 11. The width of the cleaning cloth 11 is adapted to the width to be cleaned and can extend axially over the entire cylinder 6, 7, 8. The cleaning cloth 11 can be saturated with a cleaning fluid, or moistened therewith. To that end, a sprayer bar can be provided. The cleaning cloth 11 is preferably unwound from the clean cloth spindle 14 and wound onto the dirty cloth spindle 15. The cleaning cloth 11 can be transported forward and backward and can, for example, be wound back onto the clean cloth spindle 14 from the dirty cloth spindle 15. Instead of one of the two cloth spindles 14 and 15, a different storage form for the cleaning cloth 11 can also be provided. For example, this can be kept on hand in a fan-folded stack or pile. In any case, the cleaning device 9 includes at least one cloth spindle 14, 15 that is supported rotatably by a pivot bearing 16 in a carrier 17. The rotation of the cloth spindle 14, 15 can be performed manually or preferably by a drive mechanism 32. For example, the dirty cloth spindle 15 can be driven by a pneumatic cylinder or a motor and can drive the clean cloth spindle 14, via the cleaning cloth 11 to be unwound from the clean cloth spindle 14. The cleaning cloth 11 can be transported either continuously or intermittently, before or after, on the one hand, or during, on the other hand, the cleaning process. A locking mechanism can be provided that prevents unintended unwinding of the cleaning cloth 11 from one of the cloth spindles 14 and 15 because of the friction of the rotating cylinder 6, 7, 8.

Figure 3:
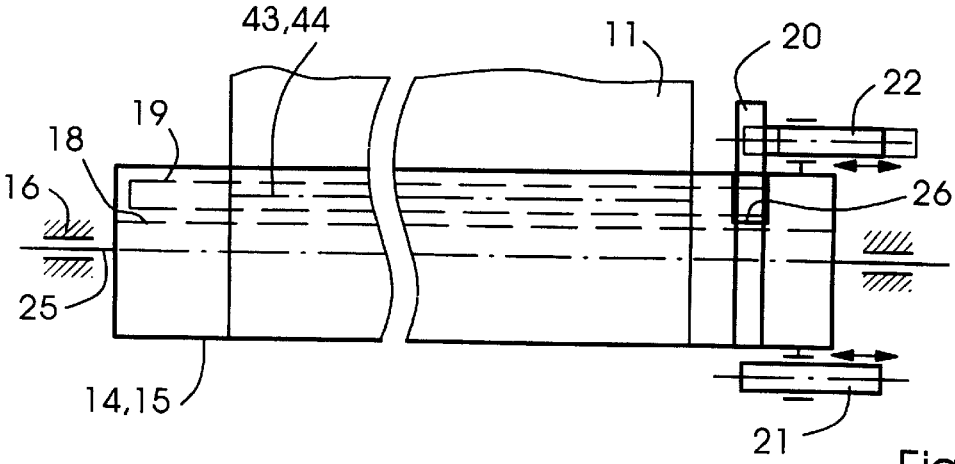
FIG. 3 is a much-enlarged fragmentary view of FIG. 2, as seen from the lefthand side thereof, with the inking-unit roller of FIG. 2 removed, showing a cloth spindle with a clamped washcloth forming part of the cleaning device in a front elevational view.
Figure 4:
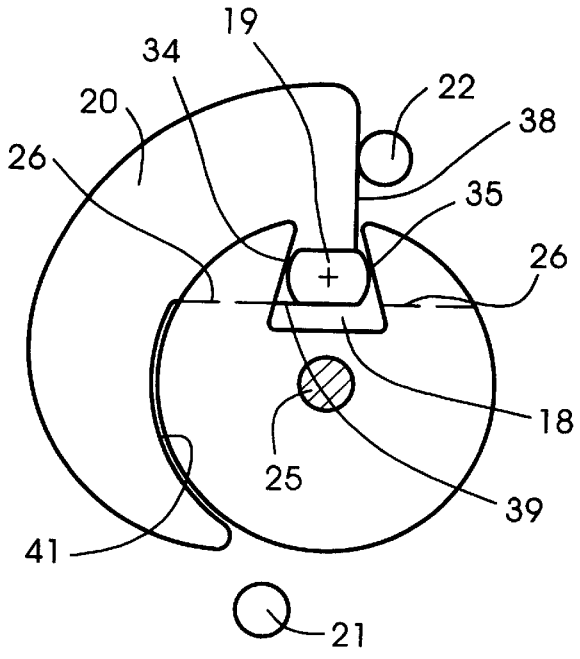
FIG. 4 is an enlarged side elevational view of FIG. 3, showing the cloth spindle in greater detail.

In FIG. 3 and the succeeding figures, there is illustrated the construction according to the invention of at least one or preferably both of the cloth spindles 14 and 15 shown in FIG. 2. The cloth spindle 14, 15 is formed with the axially parallel-extending longitudinal groove or slot 18, which can extend over the width of the cloth or, as shown, over the entire length of the cloth spindle 14, 15. The cloth spindle 14, 15 is preferably cylindrical with a circular cross section, but it can also have a polygonal, rotationally symmetrical and, for example, a square cross section. An end of the cleaning cloth 11 and at least one clamping body 19 that firmly clamps this end are located in the longitudinal groove or slot 18. The diameter of the cloth spindle 14, 15, and in the case of a non-round cloth spindle 14, 15, respectively, the cross-sectional outer dimensions, are constantly of the same size in both the clamped and the released conditions. Preferably, the clamping body 19 is embodied as a single clamping strip extending over the entire width of the cloth, as shown. Alternatively, a plurality of clamping bodies 19 can be used to fasten the cleaning cloth 11 in the longitudinal groove or slot 18. For example, the cleaning cloth 11 can be held on both sides, in the region of the side edges thereof, by two separate clamping bodies 19. The clamping body 19 is provided with an actuating part 20, that is associated with the cloth spindle 14, 15 at one end thereof free from the cleaning cloth 11. The actuating part 20 that adjusts the clamping body 19 can carry the clamping body 19 on both sides of the cleaning cloth 11. Another possible disposition of the actuating part 20 may, for example, be provided inside a hollow cloth spindle 14, 15. The clamping body 19 has at least one restraint device 21, 22, assigned thereto by which the clamping body 19 is held in the clamping position. By way of example, the restraint device 22 is embodied as a first locking member, while the restraint device 21 is embodied as a second locking member. In FIG. 4, the cloth spindle 14, 15 is shown in a side view, without any cleaning cloth 11 inserted therein. The actuating part 20 is guided in the groove or slot 26 and, in this manner, the clamping body 19 is secured in the clamping position against displacement in the axial direction of the longitudinal groove or slot 18. The groove 26 is formed as a segmented recess out of the circular cross section of the cloth spindle 14, 15. The actuating part 20 has two faces 38 and 39, acting as bearing faces, extending perpendicularly to one another. The face 38 engages the restraint device 22. The restraint device 22 is connected to the cloth spindle 14, 15. As a result, in the clamping position, the actuating part 20 is secured against shifting clockwise, as viewed in FIG. 4. The face 39 engages the bottom face of the groove 26. The face 41 of the actuating part 20 matches or is adapted to the outer contour of the cloth spindle 14, 15, so that the actuating part 20, in the clamping position, engages the cloth spindle 14, 15. In the case of the circularly profiled cloth spindle 14, 15, the face 41 can be rounded and the actuating part 20 can be crescent-shaped. Due to the bearing face 39 and additionally the bearing face 41, the actuating part 20 is secured against counterclockwise displacement, as viewed in FIG. 4. As a consequence, the clamping body 19 is held at the clamping points 34 and 35.

Figure 5:
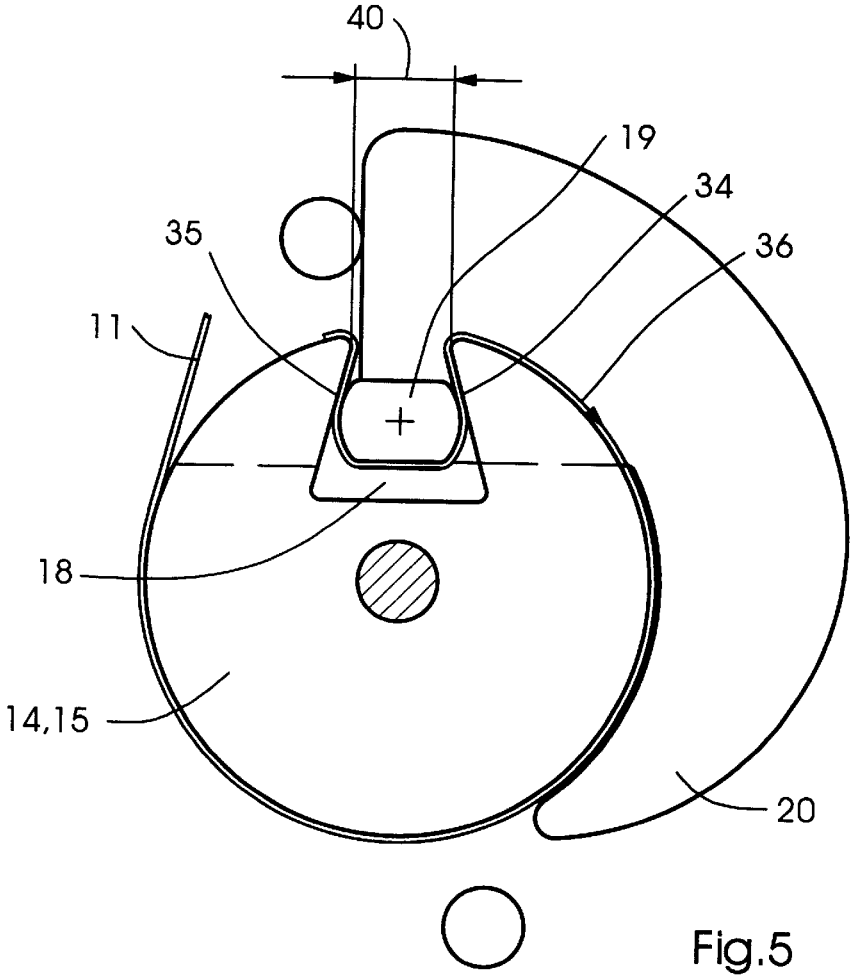
FIG. 5 is an enlarged side elevational view of FIG. 4, showing the cloth spindle in a different operating phase thereof.

In FIG. 5, the cloth spindle 14, 15 is shown from a side thereof opposite to that from which it is shown in FIG. 4, with the cleaning cloth 11 inserted into the longitudinal groove or slot 18. The cleaning cloth 11 wraps around the clamping body 19 inside the longitudinal groove or slot 18. Preferably, the cleaning cloth 11 is firmly clamped at two clamping points 34 and 35, located separated from the wrapped portion, between the outer face of the clamping body 19 and the inside face defining the longitudinal groove or slotl8. The clamping of the cleaning cloth 11 is effected along two clamping faces or clamping lines 43 and 44 (FIG. 3) that extend axially parallel to the longitudinal groove or slot 18.

The clamping body 19 in the clamping position can be supported directly and/or indirectly on two inside faces defining the longitudinal groove or slot 18. Indirect support is effected via the cleaning cloth 11 located between the clamping body 19 and the inside face of the longitudinal groove or slot 18. In that case, a single support face of the longitudinal groove or slot 18 can form a clamping face, or preferably two support faces form two clamping faces. The clamping body 19 is supported on at least an inside face of the longitudinal groove or slot 18, indirectly via the cleaning cloth 11. The inside faces on which the clamping body 19 is supported are preferably two opposed side faces defining the longitudinal groove or slot 18. In the shape and outer dimensions thereof, the clamping body 19 is adapted to the longitudinal groove 18 so that the cleaning cloth 11, when the clamping body 19 is adjusted into the clamping position, is clamped in place between at least one outer face of the clamping body and at least one inner face of the longitudinal groove or slot 18. The clamping body 19 and the longitudinal groove 18 are each profiled in a manner adapted to one another, so that the tensile force 36 applied to the cleaning cloth 11 produces self-reinforcement of the clamping. Due to the tensile force 36, the clamping body 19 is wedged increasingly in the longitudinal groove or slot 18 and thus holds the cleaning cloth 11 all the more firmly. The clamping force increases as the tensile stress increases. The cross section of the longitudinal groove or slot 18 is narrowed outwardly and in a radial direction, respectively, with regard to the cloth spindle 14, 15. The cross-sectional constriction 40 of the longitudinal groove or slot 18 can be formed as an infinitely graduated or varying taper. A graduated cross-sectional constriction, formed as a shoulder, may also be provided. The infinitely graduated taper shown is formed trapezoidally and dovetail-shaped, respectively.

Figure 6:
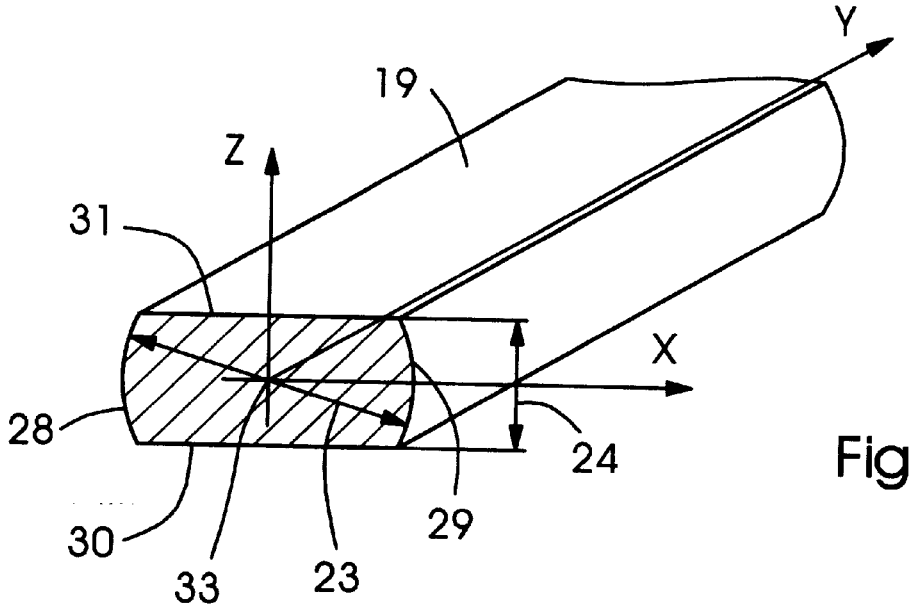
FIG. 6 is a perspective view of a clamping body in section forming part of the cleaning device.

In FIG. 6, the clamping body 19 is shown in an enlarged view. It has two curved clamping faces 28 and 29, which are diametrically opposed. This is the case, for example, with a clamping body 19 of oval or elliptical cross section. The clamping body preferably has a circular cross section with two flat faces 30 and 31. The flat faces 30 and 31 are preferably disposed parallel to one another. The maximum spacing of the curved faces 28 and 29 to one another forms a first measurement 23 of the clamping body 19. The first measurement or dimension 23 extends in a direction perpendicular to the axial direction Y. The first measurement 23 is equivalent to the diameter of the circular cross section of the clamping body 19. The linear course of the circular-arclike cross-sectional lines need not necessarily, when extended, produce an ideal circle. The sum of the two circular arc radii can have a greater value (for a circle pushed together) or a lesser value (circle spread apart) than the first measurement or dimension. The radii of the two circular arcs may also be of different lengths. The spacing between the flat faces 30 and 31 forms a second measurement or dimension 24 of the clamping body 19. The second measurement or dimension 24 extends in a direction other than the direction of the first measurement or dimension 23 and is likewise perpendicular to the axial direction Y of the clamping body 19. Preferably, the measurements or dimensions 23 and 24 extend perpendicularly to one another and perpendicularly to the axial direction Y of the clamping body 19. The measurements 23 and 24 are dimensioned differently and are preferably located in a single cross-sectional plane X-Z of the clamping body 19.

Figure 9:
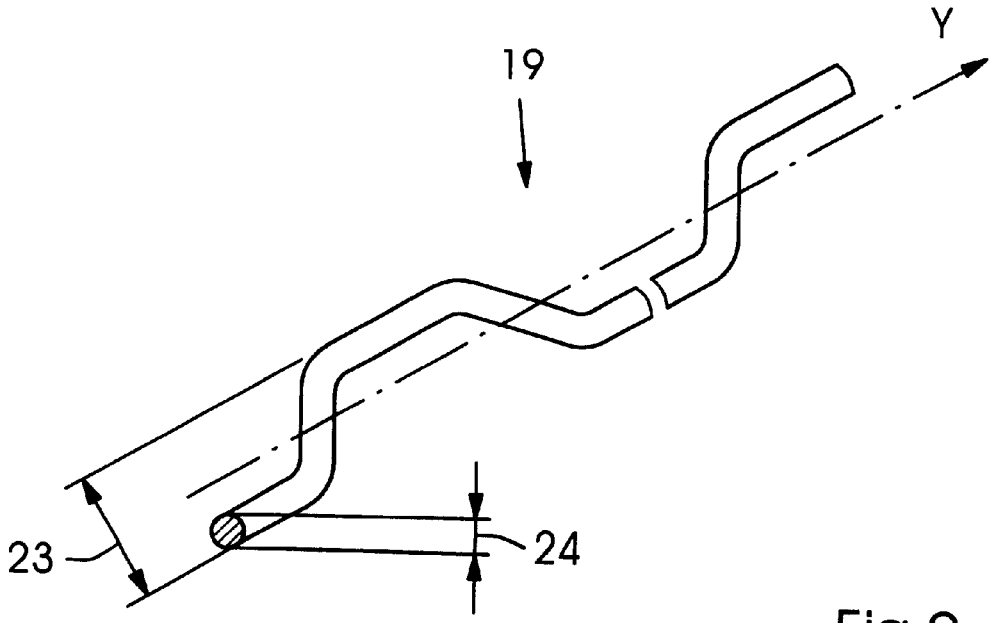
FIG. 9 is a perspective view of another embodiment of the clamping body that is crank-shaped.

However, the measurements or dimensions 23 and 24 need not necessarily extend in a single cross-sectional plane X-Z. Such an example, which is within the scope of the invention, is shown in FIG. 9. The measurement or dimension 24 forms a diameter of the circularly profiled, crank-shaped clamping body 19.

The clamping body 19 shown in FIG. 6 is so dimensioned that the second measurement 24 is narrower than the cross-sectional constriction 40 (FIG. 5).

Consequently, the clamping body 19 can be placed radially through the cross-sectional constriction 40 into the longitudinal groove or slot 18 formed in the cloth spindle 14, 15. In addition, the thickness of the material of the cleaning cloth 11 and the number of layers of the cleaning cloth 11 introduced into and extended out of the longitudinal groove or slot 18 are taken into account in dimensioning the second measurement or dimension 24, so that when the cleaning cloth 11 has been placed into the longitudinal groove or slot 18, the clamping body 19 fits through the cross-sectional constriction 40. The first measurement 23 is dimensioned so as to be wider than the cross-sectional constriction 40. Consequently, even a very thin or highly compressible cleaning cloth 11 can be held securely at all times in the longitudinal groove or slot 18. In certain applications, especially when the material of the cleaning cloth is thick, the first measurement 23 can be dimensionally equal to or less than the cross-sectional constriction 40. In that case, the cleaning cloth 11 wrapped around the clamping body 19 prevents the clamping body 19 from slipping out of the longitudinal groove 18 and thus makes the firm clamping of the cleaning cloth 11 possible. The thickness of the material of the cleaning cloth 11 inserted into the longitudinal groove or slot 18, in this case, together with the first measurement 23 of the clamping body 19, results in a spacing which is greater than the cross-sectional constriction 40.

Figure 7:
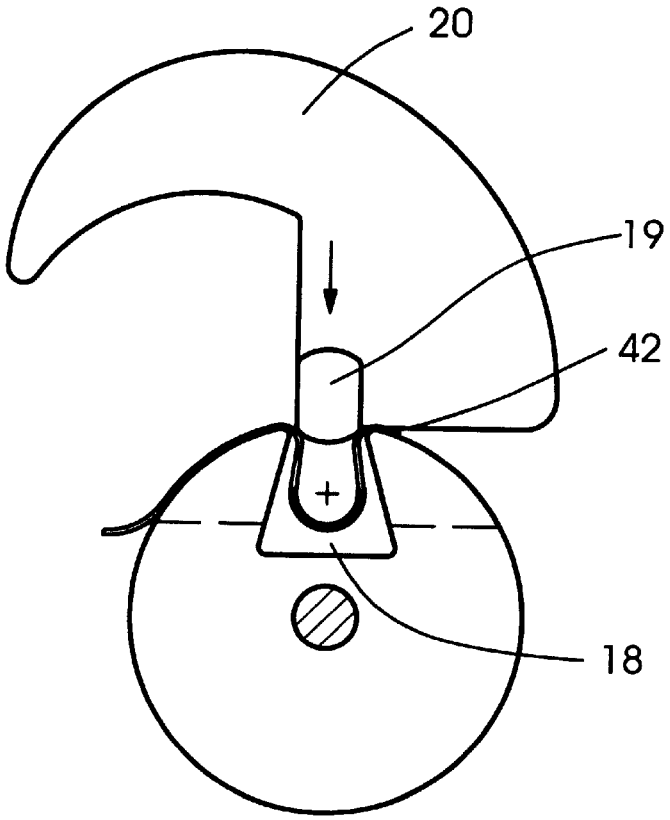
FIG. 7 is a view similar to that of FIG. 4 in a different operating phase of the cleaning device, wherein the clamping body is in a released position.
Figure 8:
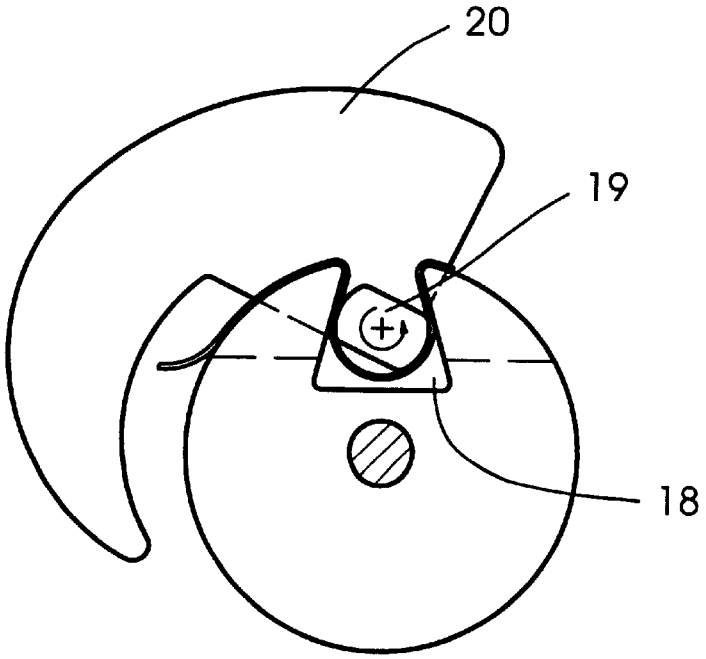
FIG. 8 is a view like that of FIG. 7 in yet a different operating phase of the cleaning device, wherein the clamping body is in an intermediate position.

The procedure for clamping the cleaning cloth 11 in place in the longitudinal groove or slot 18 is as follows:

The end of the cleaning cloth 11 to be clamped firmly is placed across the opening of the longitudinal groove or slot 18. The clamping body 19 is introduced in radial direction into the longitudinal groove 18 (FIG. 7). Before or during the introduction of the clamping body 19, the cleaning cloth 11 is pressed into the longitudinal groove 18 in such a way that, inside the longitudinal groove 18, the cleaning cloth 11 forms a snare or loop, and a short end piece 42 is prevented from sliding into the longitudinal groove 18 by a corresponding placement of the cleaning cloth 11 across the longitudinal groove 18. Upon the introduction of the clamping body 19, that is in the first position thereof, into the longitudinal groove 18 in the radial direction, the actuating part 20 is guided between the side faces of the groove 26 in such a way that the clamping body 19 is positionally secured in axial direction. The clamping body 19 is introduced so deeply into the longitudinal groove 18 that the face 38 comes into contact with the bottom of the groove 26. The clamping body 19 is then rotated out of the first position (FIG. 7) into the second position (FIGS. 4 and 5) via intermediate positions (FIG. 8). During the process, the clamping body 19 is rotated about the pivot axis 33 thereof. A displacement of the pivot axis 33 of the clamping body 19 radially outwardly with respect to the cloth spindle 14, 15 can be superimposed on the rotary motion. In this way, the clamping body 19 becomes wedged into the longitudinal groove 18, and the cleaning cloth 11 is clamped in place. The face 39 of the actuating part 20 engages the bottom of the groove 26 after the clamping body 19 has been rotated 90° counterclockwise and is in the clamping position. In the clamping position, the friction between the inside surface defining the longitudinal groove 18, the cleaning cloth 11 and the clamping body 19 is so great that it is no longer possible for the cleaning cloth 11 to slip out of the longitudinal groove 18. In this position, the face 41 of the actuating part 20 rests on the circumferential surface of the cloth spindle 14, 15. The actuating part 20 is crescent-shaped and, together with the cloth spindle 14, 15, creates a substantially closed form in side view without corners and edges that could cause injuries. Locking of the clamping body 19 in the second position thereof then follows. This is effected by displacing or screwing the pin 22 out of the first pin position shown in bold lines in FIG. 3 and into the second pin position shown in lighter lines. Alternatively, provision may be made for the cloth spindle 14, 15, to be displaced in the axial direction thereof together with the actuating part 20, so that locking of the actuating part 20 by the pin 22 is likewise effected by this kinematic reversal. In that case, the pin 22 is not disposed directly on the cloth spindle 14, 15 but rather on a driver coaxially supported with respect to the cloth spindle 14, 15. The clamping body 19 can additionally be locked by a further restraint device 21. The release of the clamping action is accomplished in reverse order. The clamping body 19 is then rotated backwards in the opposite direction.

In the case of a dirty cloth spindle on which the soiled cleaning cloth 11 is wound in such a manner as to cover the longitudinal groove 18, the clamping body 19 is pulled axially out of the longitudinal groove. After the spindle, such as a clean cloth spindle, has been completely unwound, the clamping body 19 can be removed from the longitudinal groove 18 in the axial and/or radial direction.

We claim:

1. A cleaning device for a printing press, comprising:

a cloth spindle formed with a longitudinal groove having an inner face; a cleaning cloth clampable in said longitudinal groove;

a clamping body rotatable inside said longitudinal groove out of a first position, wherein clamping of the cleaning cloth is undone, and into a second position, wherein the cleaning cloth is clamped between the clamping body and said inner face of said longitudinal groove;

wherein said clamping body and said longitudinal groove are profiled so that a tensile force applied to said cleaning cloth produces a self-reinforcement of the clamping.

2. The cleaning device according to claim 1, wherein said clamping body, due to the rotation thereof out of said first position and into said second position, is wedgable in the longitudinal groove so as to clamp the cleaning cloth therein.

3. The cleaning device according to claim 1, wherein said first position of said clamping body is substantially perpendicular to said second position thereof.

4. The cleaning device according to claim 1, wherein said longitudinal groove narrows trapezoidally towards the outside relative to the cloth spindle.

5. The cleaning device according to claim 4, wherein said longitudinal groove narrows in a dovetail-shaped manner towards the outside relative to the cloth spindle.

6. The cleaning device according to claim 1, wherein said clamping body is formed with two mutually opposite convex clamping faces.

7. The cleaning device according to claim 1, wherein said clamping body has a first dimension measurement and a second dimension measurement extending perpendicularly to a pivot axis of said clamping body and in different directions relative to one another, said first dimension measurement being greater than said second dimension measurement.

8. The cleaning device according to claim 7, wherein said clamping body has a shape where two faces are curved and two faces are flat disposed opposite one another.

9. The cleaning device according to claim 1, including at least one restraint device for preventing unintended undoing of the clamping of the cleaning cloth and for securing said clamping body against displacement.

10. The cleaning device according to claim 1, wherein said clamping body has a rigid structure.

11. The cleaning device according to claim 1, further comprising two clamping lines wherein said longitudinal groove and said clamping body are profiled so that said cleaning cloth wrapped around said clamping body is firmly clamped along said two clamping lines extending parallel to one another, between said clamping body in said clamping position, and said longitudinal groove.

12. The cleaning device according to claim 1, wherein said clamping body in said clamping position is located entirely inside the longitudinal groove.

13. A printing press, comprising in combination therewith at least one cleaning device according to claim 1.

14. A rotary printing press, comprising in combination therewith at least one cleaning device according to claim 1.

15. A cleaning device for a printing press, comprising:

a cloth spindle formed with a longitudinal groove having an inner face;

a cleaning cloth clampable in said longitudinal groove;

a clamping body rotatable inside said longitudinal groove out of a first position and into a second position, thereby being wedged in said longitudinal groove so as to clamp said cleaning cloth between an outer surface of said clamping body and an area of said inner face where there is a continuous and graduate narrowing of said longitudinal groove;

wherein said clamping body and said longitudinal groove are profiled so that a tensile force applied to said cleaning cloth produces a self-reinforcement of the clamping.

* * * * *